US010383413B1

(12) United States Patent
Tanguay

(10) Patent No.: US 10,383,413 B1
(45) Date of Patent: Aug. 20, 2019

(54) RING SUPPORT

(71) Applicant: Brian Tanguay, Templeton, MA (US)

(72) Inventor: Brian Tanguay, Templeton, MA (US)

(73) Assignee: Brian Tanguay, Templeton, MA (US)

( * ) Notice: Subject to any disclaimer, the term of this patent is extended or adjusted under 35 U.S.C. 154(b) by 0 days.

(21) Appl. No.: 16/117,512

(22) Filed: Aug. 30, 2018

(51) Int. Cl.
*A44C 9/00* (2006.01)
*A44C 9/02* (2006.01)

(52) U.S. Cl.
CPC ..... *A44C 9/0053* (2013.01); *A44C 9/02* (2013.01)

(58) Field of Classification Search
CPC .... A44C 9/0092; A44C 9/0053; A44C 9/0061
USPC ..... 63/15.4, 15.8
See application file for complete search history.

(56) References Cited

U.S. PATENT DOCUMENTS 1,533,441 A * 4/1925 Melling ..... A44C 9/0092 63/15.8
3,745,788 A 7/1973 Sullivan
4,526,016 A 7/1985 Cercone
6,672,105 B1 1/2004 Sills
7,150,164 B2 12/2006 Sills
D604,193 S 11/2009 Kohl
2007/0137250 A1 6/2007 Kohl
2011/0289966 A1 12/2011 Ahrenholtz et al.

FOREIGN PATENT DOCUMENTS

WO 2010148347 A2 12/2010

* cited by examiner

*Primary Examiner* — Abigail E Troy
(74) *Attorney, Agent, or Firm* — McInnes & McLane LLP; Seth A. Milman

(57) ABSTRACT

A ring support and method of supporting a ring on a finger of a wearer having an enlarged knuckle, includes a soft, pliable ring-shaped body sized and dimensioned to slide over the wearer's enlarged knuckle and rest securely on a finger segment of the wearer. The body has a thickness sized and dimensioned to a ring size substantially as large as the wearer's enlarged knuckle and an outer surface on an outer circumference configured to receive a ring. The ring support may further include a channel to receive the ring on the outer circumference of the body, which may include a first flange and a second flange. The ring support may be made from silicone rubber.

14 Claims, 2 Drawing Sheets

RING SUPPORT

FIELD

The present patent documents relates generally to jewelry rings worn on the fingers, and more particularly to a ring support configured to support a ring comfortably on the proximal phalanx of a finger of the person with enlarged inter-phalangeal joints or knuckles due to arthritis, other illness that enlarges the joints, or injury.

BACKGROUND

Many people enjoy wearing jewelry rings from merely ornamental rings to the ceremonial wedding bands and engagement rings. Rings are commonly worn on the proximal phalanx or segment of one or more fingers of the hands. However, due to aging, illness, or injury, in some people the proximal knuckle or joint may become enlarged making it difficult or impossible to place on or remove a ring from the finger. Wearer's have resorted to wearing enlarged rings or stretching rings to a sufficiently large diameter to pass over the enlarged knuckle. However, because the proximal finger segment is much narrower in diameter than the enlarged knuckle, the ring fit is loose, allowing the ring to flop around undesirably on the finger segment.

SUMMARY

Therefore, there is a perceived need in the industry for a device or method of allowing a ring to pass over an enlarged knuckle yet sit securely and comfortably on the segment of the finger, without feeling loose or flopping around.

The ring support and method of supporting a ring described herein solves the problems of the prior art by providing a ring support with a soft, pliable ring-shaped body sized and dimensioned to slide over the wearer's enlarged knuckle and rest securely on a finger segment of the wearer. The body has a thickness sized and dimensioned to a ring size substantially as large as the wearer's enlarged knuckle and an outer surface on an outer circumference configured to receive a ring. The ring support may further include a channel to receive the ring on the outer circumference of the body, which may include a first flange and a second flange. The ring support may be made from silicone rubber.

The ring support may include standard ring sizing for convenience and ease of fitting. For instance, the inner circumference may have a ring size from 0-16, including half and quarter sizes. Similarly, the outer circumference may have similar ring sizing.

BRIEF DESCRIPTION OF THE DRAWINGS

Various aspects of at least one embodiment are discussed below with reference to the accompanying figures, which are not necessarily drawn to scale, emphasis instead being placed upon illustrating the principles disclosed herein. The figures are included to provide an illustration and a further understanding of the various aspects and embodiments, and are incorporated in and constitute a part of this specification, but are not intended as a definition of the limits of any particular embodiment. The figures, together with the remainder of the specification, serve only to explain principles and operations of the described and claimed aspects and embodiments, but are not to be construed as limiting embodiments. In the figures, each identical or nearly identical component that is illustrated in various figures is represented by a like numeral. For purposes of clarity, not every component may be labeled in every figure.

DETAILED DESCRIPTION OF THE ILLUSTRATIVE EMBODIMENTS

Figure 1:
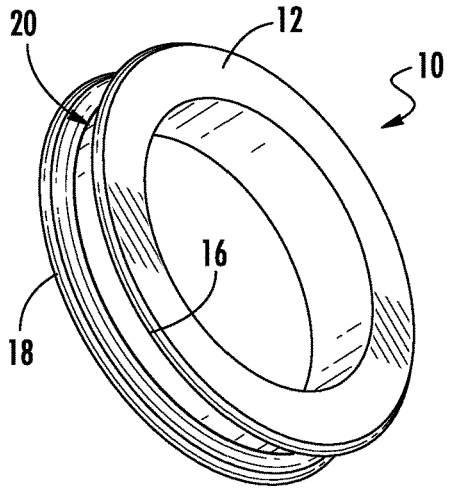
FIG. 1 is a perspective view of an exemplary embodiment of a ring support described herein.
Figure 2:
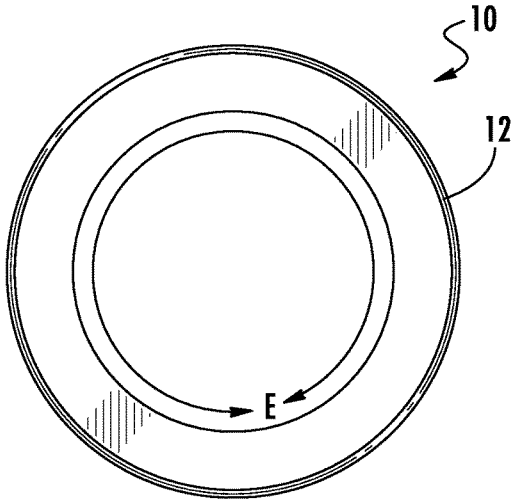
FIG. 2 is a front view thereof.
Figure 3:
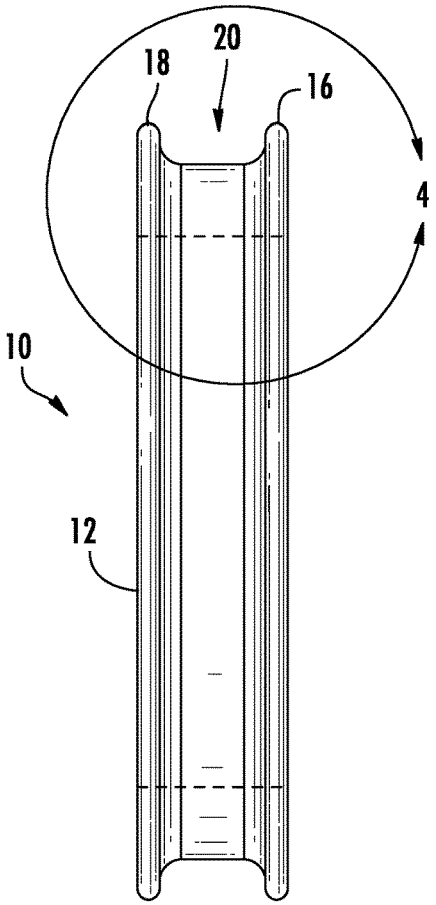
FIG. 3 is a side view thereof.
Figure 4:
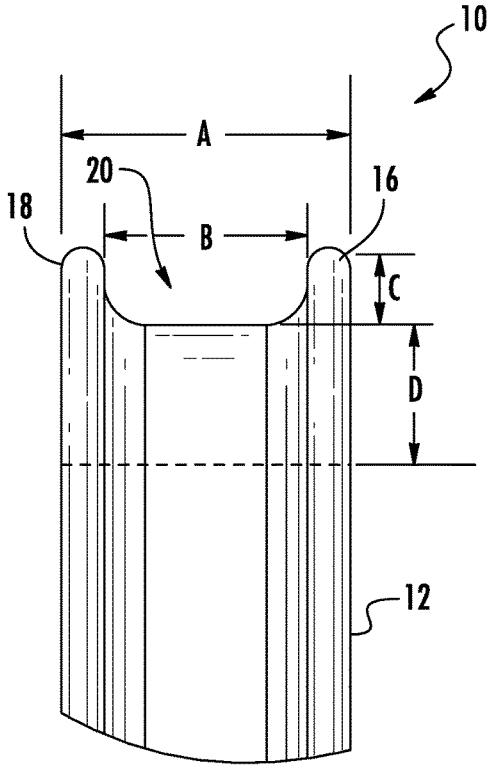
FIG. 4 is a closeup view of Inset 4 of FIG. 3.

The examples of the apparatus discussed herein are not limited in application to the details of construction and the arrangement of components set forth in the following description or illustrated in the accompanying drawings. It will be understood to one of skill in the art that the apparatus is capable of implementation in other embodiments and of being practiced or carried out in various ways. Examples of specific embodiments are provided herein for illustrative purposes only and are not intended to be limiting. Also, the phraseology and terminology used herein is for the purpose of description and should not be regarded as limiting. Any references to examples, embodiments, components, elements or acts of the apparatus herein referred to in the singular may also embrace embodiments including a plurality, and any references in plural to any embodiment, component, element or act herein may also embrace embodiments including only a singularity (or unitary structure). References in the singular or plural form are not intended to limit the presently disclosed apparatus, its components, acts, or elements. The use herein of "including," "comprising," "having," "containing," "involving," and variations thereof is meant to encompass the items listed thereafter and equivalents thereof as well as additional items. References to "or" may be construed as inclusive so that any terms described using "or" may indicate any of a single, more than one, and all of the described terms.

Referring to FIGS. 1-4, the ring support is generally shown at 10. The ring support has a ring-shaped body 12 made from a soft, pliable elastomer material, such as silicone rubber, which allows the body 12 to stretch and deform but return to its original shape. The ring-shaped body 12 may have a width A, which is selected to be wider than a desired jewelry ring 14 to be fit for the wearer. Extending from the ring support 10 are a first flange 16 and a second flange 18 (collectively, the "flanges"), forming a U-shaped channel 20 on an outer circumference of the body 12, having a width B inside the width A of the body 12. The flanges 16, 18 extend from the body 12 to height C. The flanges 16, 18 are relatively thin in comparison to the width A and thickness D of the body 12. Because of this thinness and the elastic properties of the material of the body 12, the flanges 16, 18 may deflect easily.

The ring support 10 also has an inner circumference of size E, which is selected based on standard ring sizing charts, which generally run from 0-16, including half and quarter sizes, or an alphabetical scale, corresponding to the number of millimeters of the circumference of the ring.

Thickness D of the body 12 is a sufficient thickness such that the outer circumference, as measured from the inner circumference of the body 12 to the troth of the U-shaped channel 20, is of a size of the desired ring size of the enlarged ring.

Figure 5:
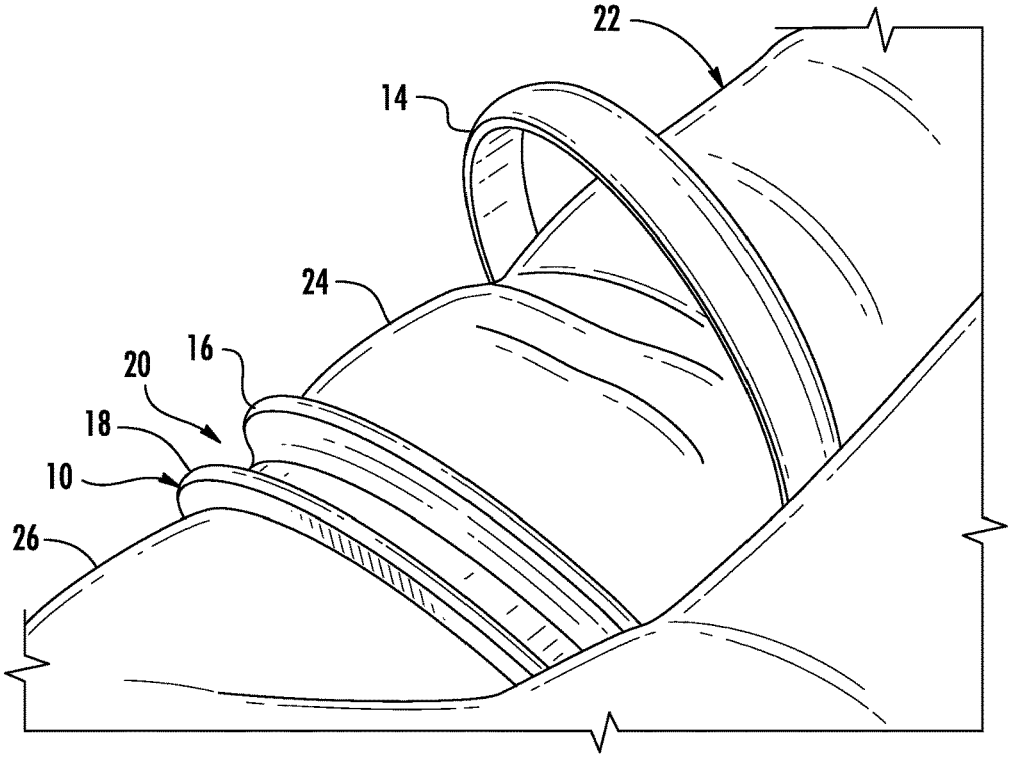
FIG. 5 is a perspective view of a wearer positioning the ring support on a finger.
Figure 6:
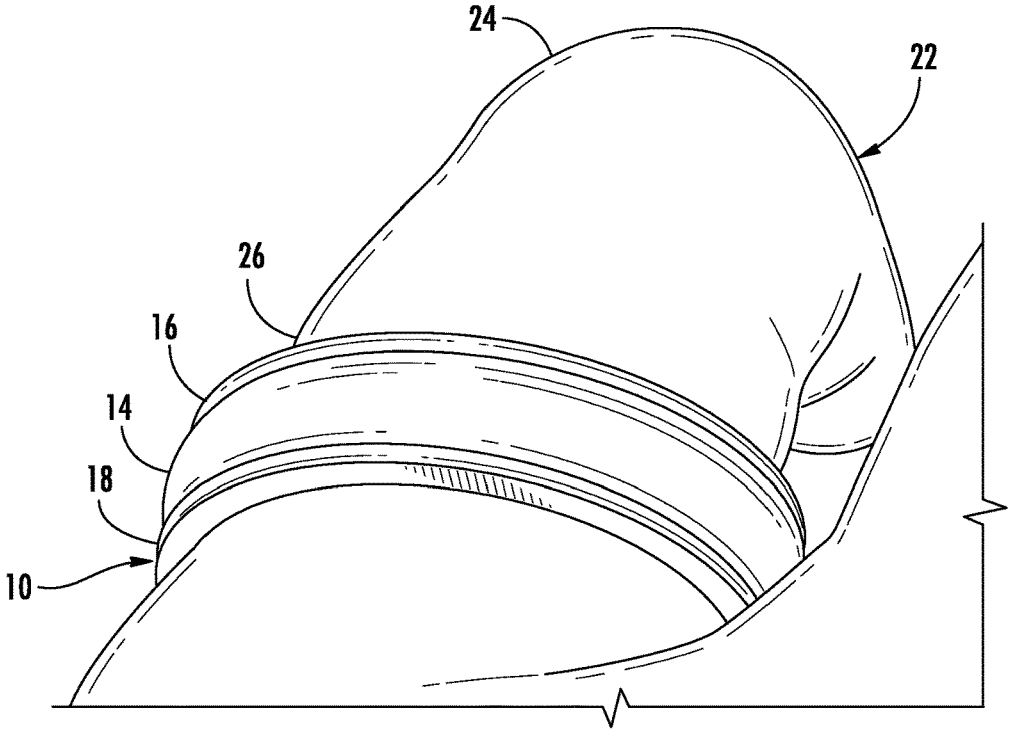
FIG. 6 is a perspective view of a wearer positioning a ring over the ring support on a finger.

Referring to FIGS. 5 and 6, a method of supporting a ring on a finger 22 with a ring support 10 is shown generally. In a first step, the user places the ring support 10 on a finger 22. The user deforms the body 12 to pass over the user's enlarged knuckle 24. Once past the enlarged knuckle 24, the ring-shaped body 12 returns to its original shape and size. The user then positions the ring support 10 on the desired location of the user's finger segment 26. The user then slides the jewelry ring 14, of a sufficiently large enough size on the finger 22 and over the enlarged knuckle 24. Once over the enlarged knuckle 24, the user presses the jewelry ring 14 onto the ring support 10. As the user presses the ring 14 onto the ring support 10 the first flange 16 nearest the ring 14 will deflect inwardly, allowing the ring 10 to be positioned within the U-shaped channel 20 of the ring support 20. Pushing further, the second flange 18 will deflect outwardly, allowing the first flange 16 to reset to its upright position. The user then draws the ring 14 back into the U-shaped channel 20, with the first flange 16 and second flange 18 securely cupping the ring 14 within the U-shaped channel 20. Because the ring-shaped body 12 is sized for the user's finger segment 26 and has thickness D equivalent to the ring size of the ring 14, the ring 14 is held securely on the user's finger 22 and does not flop around.

A method of forming a ring support 10 for a ring 14 for a wearer with an enlarged knuckle 24 is also disclosed. In a first step, the size of the wearer's enlarged knuckle 24 is determined. For instance, the circumference of the knuckle 24 may be measured in millimeters or standard ring sizes. In a second step, the size of the wearer's finger segment 26 is determined. As with the wearer's knuckle 24, the circumference of the wearer's finger segment 26 may be measured too. In a third step, a ring support 10 is selected having an inner size corresponding to the wearer's finger segment 26 ring size and an outer circumference corresponding to the wearer's knuckle 24 ring size. In a fourth step a ring 14 is selected having a ring size corresponding to the wearer's knuckle 24 ring size. Alternatively, a ring 14 may be resized to a ring size corresponding to the wearer's knuckle 24 ring size. In a fifth step, the wearer places the ring support 10 on their finger segment 26 and assesses the comfort of the fit. In a sixth step, the wearer places the ring 14 on the ring support 10, as described above, and assesses the comfort of the fit of the ring 14 and ring support 10 in an assembled relation on the finger segment 26.

Therefore, it can be seen that the ring support described herein provides a novel and unique solution to the problem of providing a device and method to securely hold a ring on a user's finger who has an enlarged knuckle. The ring support allows the ring to be put on and taken off without difficulty and also prevents flopping of the ring on the finger segment.

Those skilled in the art will appreciate that the conception, upon which this disclosure is based, may readily be utilized as a basis for designing other products without departing from the spirit and scope of the invention as defined by the appended claims. Therefore, the claims are not to be limited to the specific examples depicted herein. For example, the features of one example disclosed above can be used with the features of another example. Furthermore, various modifications and rearrangements of the parts may be made without departing from the spirit and scope of the underlying inventive concept. For example, the geometric configurations disclosed herein may be altered depending upon the application, as may the material selection for the components. Thus, the details of these components as set forth in the above-described examples, should not limit the scope of the claims.

What is claimed is:

1. A ring support comprising:

a pliable, ring-shaped body having a substantially concave u-shaped channel around an outer circumference of the ring-shaped body, the concave u-shaped channel comprising:

a center area having a center diameter at a center point;

a first side flange on one side of the center area having a diameter greater than the center diameter; and a second side flange on an opposite side of the center area having a diameter greater than the center diameter;

wherein the center point is spaced substantially equidistant from the first side flange and the second side flange;

wherein the center area, the first side flange, and the second side flange form the concave u-shaped channel; and wherein the center diameter corresponds to a predetermined ring size so that a ring having the predetermined ring size fits within the u-shaped channel.

2. The ring support of claim 1, wherein the ring-shaped body comprises silicone rubber.

3. The ring support of claim 1, wherein the body comprises an inner circumference corresponding to a second ring size that is smaller than the predetermined ring size.

4. The ring support of claim 3, wherein the second ring size is about ring size 0 to about ring size 16.

5. A ring support comprising:

a ring-shaped body having an inner surface having an inner diameter and a substantially concave u-shaped channel around an outer circumference of the ring-shaped body, the u-shaped channel comprising:

a center area having a center diameter at a center point;

a first side flange on one side of the center area having a diameter greater than the center diameter; and a second side flange on an opposite side of the center area having a diameter greater than the center diameter area;

wherein the center point is spaced substantially equidistant from the first side flange and the second side flange;

wherein the center area, the first side flange, and the second side flange form the concave u-shaped channel;

wherein the center diameter corresponds to a predetermined ring size so that a ring having the predetermined ring size fits within the u-shaped channel; and wherein the ring-shaped body comprises a material with elasticity to allow the ring-shaped body to expand to an expanded state to fit over an object and return to a normal state to accept the ring in the u-shaped channel.

6. The ring support of claim 5, wherein the body has a thickness such that the inner diameter corresponds to a second ring size and the center area corresponds to the predetermined ring size when the ring-shaped body is in the normal state.

7. The ring support of claim 6, wherein the second ring size of the inner circumference is from about ring size 0 to about ring size 16.

8. The ring support of claim 5, wherein the ring-shaped body is formed from silicone rubber.

9. The ring support of claim 5, wherein the second ring size is smaller than the predetermined ring size.

10. A ring support comprising:

an elastomeric body having a substantially concave u-shaped channel around an outer circumference of the body, the u-shaped channel comprising:

a center area having a center diameter at a center point;

a first side flange on one side of the center area having a diameter greater than the center diameter; and a second side flange on an opposite side of the center area having a diameter greater than the center diameter;

wherein the center point is spaced substantially equidistant from the first side flange and the second side flange;

wherein the center area, the first side flange, and the second side flange form the concave u-shaped channel; and wherein the center diameter corresponds to a predetermined ring size so that a ring having the predetermined ring size fits within the u-shaped channel.

11. The ring support of claim 10, wherein the first side flange and the second side flange laterally deflect when subjected to a lateral force.

12. The ring support of claim 10, wherein the body is formed from silicone rubber.

13. The ring support of claim 10, wherein the body comprises an inner diameter that corresponds to a second ring size, wherein the second ring size is smaller than the predetermined ring size.

14. The ring support of claim 13, wherein the predetermined ring size and/or the second ring size ranges from about ring size 0 to about ring size 16.

* * * * *